United States Patent [19]

Nolan

[11] 4,407,028

[45] Oct. 4, 1983

[54] ENERGY WATER-SAVER HOME SHAMPOOER

[76] Inventor: William D. Nolan, 3100 Grant St., Wichita Falls, Tex. 76308

[21] Appl. No.: 234,254

[22] Filed: Feb. 13, 1981

[51] Int. Cl.[3] ..... A54D 19/04

[52] U.S. Cl. ..... 4/516; 4/519

[58] Field of Search ..... 4/515–519; 128/65

[56] References Cited

U.S. PATENT DOCUMENTS

| | | | |
|---|---|---|---|
| 1,470,311 | 10/1923 | Wirth | 4/517 |
| 2,854,969 | 10/1958 | Nolan | 4/518 X |
| 2,854,970 | 10/1958 | Nolan | 128/65 |
| 3,416,517 | 12/1968 | Adams et al. | 4/516 X |
| 3,428,361 | 2/1969 | Reynolds | 4/517 X |
| 3,894,546 | 7/1975 | Nolan | 128/65 |
| 4,081,867 | 4/1978 | Simeola | 4/516 |

*Primary Examiner*—Charles E. Phillips

*Attorney, Agent, or Firm*—Warren H. Kintzinger

[57] ABSTRACT

A manually operated apparatus for selectively directing shampoo solutions onto the hair and scalp of a person while the individual is sitting in a semi-reclining position. The apparatus is constructed so it may give a wetting action to the hair and scalp prior to directing shampoo onto the hair and scalp for predetermined length of time and to direct rinse water thereonto and the device includes applicators which are manually actuated to move in a circular fashion relative to the users head as desired providing high volume with low pressure to desired portions of the users head.

3 Claims, 7 Drawing Figures

ENERGY WATER-SAVER HOME SHAMPOOER

BACKGROUND OF INVENTION

Various appliances and machines for shampooing hair and scalp treatment have been proposed heretofore, but these for the most part were devices to be used in beauty salons and tonsorial parlors needing special chairs for the users. These bearing large and complex having many electrical apparatuses for temperature control of water, timing of the cycles, the opening and closing of water valves, etc. The present device being a portable light weight self-contained shampooer having its own back support needing now special chair. Use any place in the home where two special screws are placed to support it, and after use taken down and stored until next use.

SUMMARY OF THE INVENTION

This invention relates to improvements in U.S. Pat. No. 3,894,546 for applying solutions to the hair and scalp. Having its own back support attached, having its own water supply and means for injecting different treatment into that water supply as it is used. A means for control of the exact area of the head by the user, means for bringing that water supply in for circulation, means for ejecting used solutions after each treatment cycle, all done manually by the user.

One objective of this device is to make it possible for the user to sit in a reclining or semi-reclining position—back resting on back support attached under the neck support on the bottom basin housing, top cover closed enclosing portion of head to be treated and user to direct all operatins from controls on crank handle.

Another objective of this invention is to provide a Home Shampooer which is so simple that it could be manufactured at the least expense to the homeowner by a company that makes lightweight products out of plastic, such as a toy manufacturer.

Another objective of this invention is a shampooer and solution applicator, using as little water and energy to heat that water as possible, but not limited to time of any of the cycles because of use of water recycling.

Still another objective of this device is to make a small and simple to operate Home Shampooer that is self-contained, needing now special chair for the user, is easy to set up, take down, and store after use.

A further objective of the invention is a device that would treat the hair and scalp with large volumes of solutions under moderate pressure where the user has the control of the area to be treated.

Yet another objective of this invention is to make an inexpensive Home Shampooer even though it was designed for the home consumer market, adaptable for the beauty and barber shops by merely installing shampoo basins fixtures and connecting drain.

Yet still another objective of this invention is means whereby the user could have an unlimited number of treatments by filling treatment bulbs before use and injecting these treatments manually into treatment compartments.

BRIEF DESCRIPTION OF THE DRAWINGS

With these objectives in mind and others which will become manifest as the description procedes, references are to be had to the accompanying drawings in which later reference characters designate like parts in the several views thereof, in which.

DESCRIPTION OF THE PREFERRED EMBODIMENT

Figure 1:
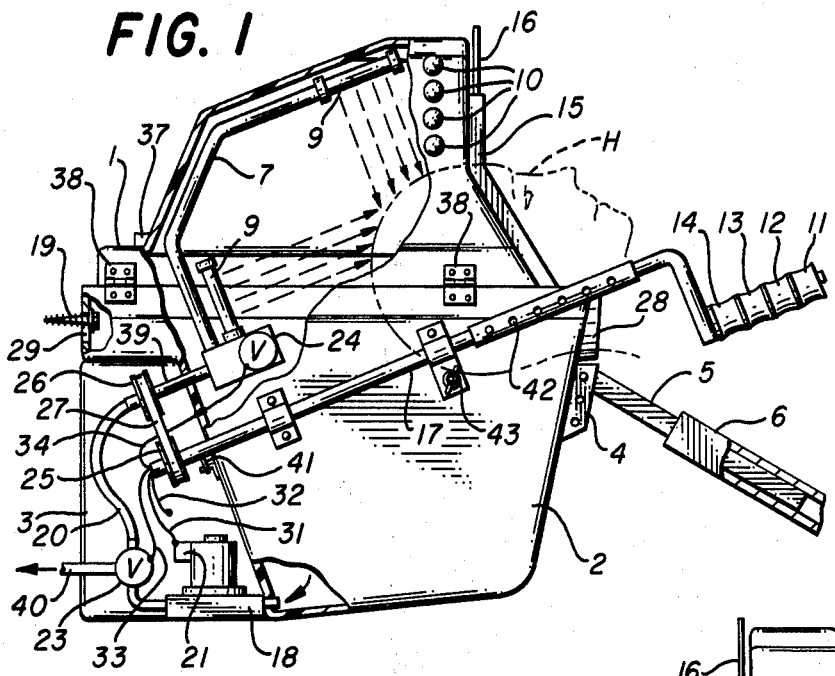
FIG. 1 is a side elevational view of the device for applying solutions to the hair and scalp, with parts being broken away and parts shown in section to bring out the details of construction.
Figure 2:
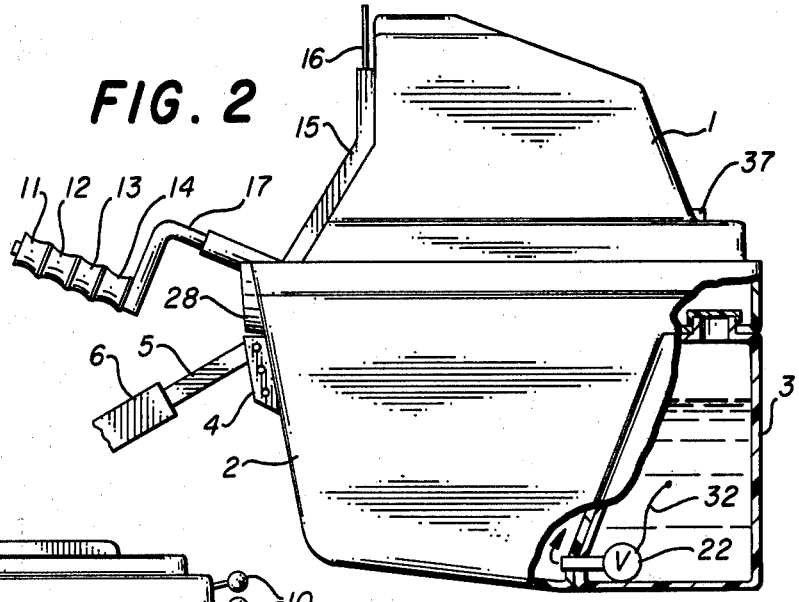
FIG. 2 is a side elevation view taken from opposite side of that shown in FIG. 1, but with parts broken away and shown in sections bringing out details of construction.
Figure 3:
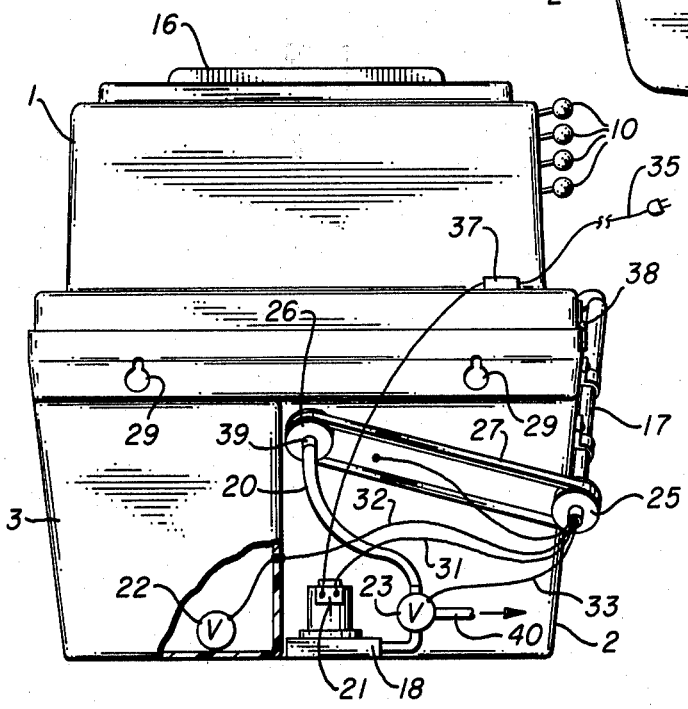
FIG. 3 is a rear view, but with parts broken away to bring out detail of construction.
Figure 4:
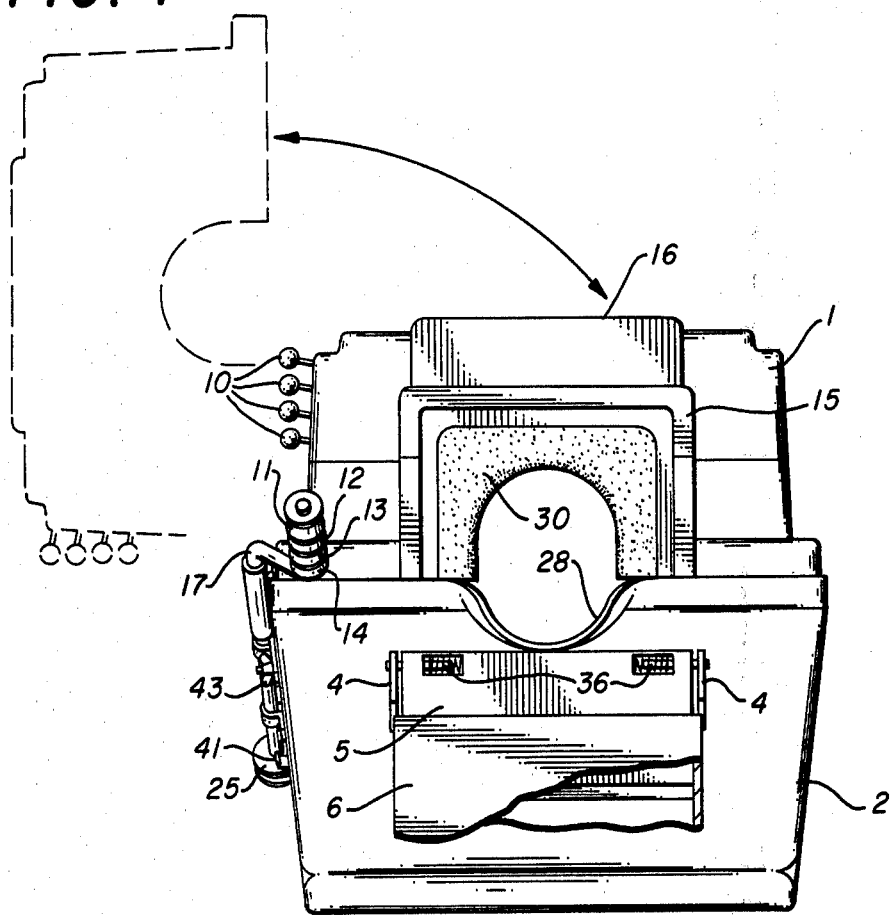
FIG. 4 is a front elevation view of the device for applying solutions to hair and scalp.
Figure 5:
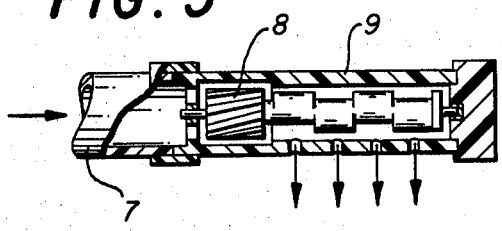
FIG. 5 is a side view of applicator with parts broken away to bring out details of construction.
Figure 6:
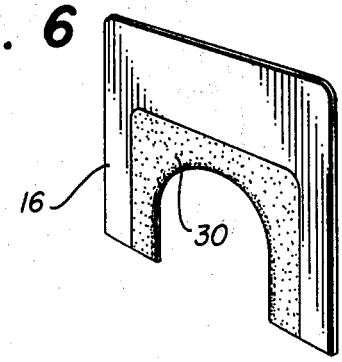
FIG. 6 is a perspective view of baffle which slides into top cover portion, encloses the portion of the head to be treated.
Figure 7:
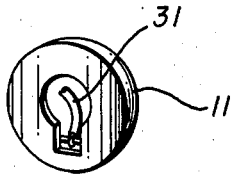
FIG. 7 is a perspective view air actuating pump for switch and valve operations.

With more detailed reference to the drawings the numeral 1 designates the top cover of the lower basin 2. This basin portion having a cutout 28 formed to receive the neck which supports the head H while it is being treated with solutions below this cutout 28 and to each side are two brackets 4 with means to support an adjustable length back support 5-6 at different elevations. Top cover 1 is hinged 38 on the left side. When this top cover 1 is raised, a mercury switch 37 breaks power supply 35, a safety feature. A number of bulbs 10 somewhat like battery test bulbs are positioned in this top cover so user can discharge various treatments manually into the solution applying area. On the front side of this top portion 1 is a flange grooved 15 to receive baffle 16, which has soft rubberlike material 30 that presses against the face of the user. A water storage tank 3 is provided with valve 22 which allows water to enter lower basin 2. Crank mechanism 17 has, on its handle, four air pump actuators 11-12-13-14. FIG. 7 shows how a small air hose is connected to each pump actuator. 11 goes to the power supply switch 21, 12 goes to water storage valve 22. 13 goes to the water exit valve 23, 14 goes to valve 24 on the manifold 7 that has the two applicators 9, a turbine cam 8 inside the applicator with means to distribute the solution up and down its length without cutting volume as it reaches the head. Pin engaging mechanisms 36 mount back support 5 on front wall brackets 4. Two button holes 29 are formed in the back of the bottom basin housing so that when this housing 2 is slipped over two screws 19, it is fully supported. A pump and motor assembly 18 circulates solutions through valve 23 and through a flexible hose 20 having the ability to twist 180° each way allowing the manifold 7 and applicators 9 to be turned a full 360° relative to the head. The crank control mechanism 17 is turned by the user 360°. A pulley 25 and belt 27 transfers power from crank to pulley 26 on the conduit system 39, air actuator pump 13 actuates valve 23 to discharge solution after use through hose 40. A stopping mechanism 41 on the crankshaft 17 and housing 2 limits the shaft to 360° of turn. Air pump actuators 11-12-13-14 on crank 17 have air lines 31, 32, 33, 34 going down through shaft 17 out to switch 21 and valves 22, 23, 24. Control crank arm 17 has means to be extendable and contractable by a pin and tube on shaft interconnect structure 42 somewhat like a metal hand cane, as well as a releasable bracket controlled by a bracket and wing nut 43 structure that may be loosened to permit rotative movement of the control crank arm 17.

OPERATION

Place two large metal screws with large head solidly into wall or door 16 inches apart, 30 inches high. Place shampooer in place, button hole principle, place chair without arm rest but with back rest opposite control handle, extend back rest of shampooer to seat of chair and adjust for comfort. Fill reserve tank with warm water, six quarts, and place filling pail at the bottom to catch exit water. Fill treatment bulbs and place into top cover, connect to power supply. Lay back on back support and close top cover, press face baffle down to form watertight fit. Grip handle, turn motor on and off with actuator 1, turn on, press actuator 2 when water force is in full, release and manually eject treatment into water supply by squeezing bulbs, grasp handle and turn a full 360° going back and forth fast, slow or stop, work actuator 14 while moving crank. This switches water supply from one applicator head to the other via valve 23, back to top of the head. After a minute or so, eject used water by squeezing actuator 3. One cycle is complete, start another by bringing new water in and adding treatment. Four complete cycles completes a normal shampoo and treatment.

What is claimed is:

1. Apparatus for applying solutions to the human head comprising: a cabinet with an upper closure mounted on a lower housing having front, rear, side walls and means for mounting said cabinet on a support structure, said front wall having inclined means mounted thereon to support the back of the user in a semi reclining position, said front wall having a cutout surface area adapted to receive and support the user's head and neck in a desired position within the cabinet, in further combination with a liquid resevoir in said housing and means for pumping liquid from said resevoir to a valve mounted externally of the rear wall of said housing, in further combination with a conduit connecting said valve with a second valve inside said cabinet connected to lower and upper applicators via a manifold, in further combination with rotating means causing circular movement of said applicators about the user's head, in further combination with a handle located adjacent said front wall for operating said rotating means whereby the user may rotate the applicators to any desired position as desired, in still further combination with valve actuator means to selectively control via said second valve the application of liquid from said lower applicator and said upper applicator, said actuator means being located in said handle, in further combination with a baffle mounted on said closure for resting on the user's face and pivoted means for pivoting the closure from an open to closed position.

2. The apparatus as in claim 1, wherein said closure has a series of bulbs mounted thereon for ejecting treatment material into the cabinet interior.

3. The apparatus as in claim 2 wherein the rotating means comprises a pully sheave connection between the operating handle and a shaft conduit upon which the manifold is mounted on.

* * * * *